US006135289A

United States Patent [19]

Miller

[11] Patent Number: 6,135,289

[45] Date of Patent: Oct. 24, 2000

[54] SHIPPING CONTAINING AND DISPLAY CASE FOR FASTENING PACKAGES

[75] Inventor: Christopher T. Miller, Long Beach, Calif.

[73] Assignee: Master Fasteners Inc., Vernon, Calif.

[21] Appl. No.: 09/458,782

[22] Filed: Dec. 10, 1999

[51] Int. Cl.[7] ..... B65D 5/54

[52] U.S. Cl. ..... 206/774; 206/470; 206/485; 206/523; 206/526; 229/235

[58] Field of Search ..... 206/736, 738, 206/745, 746, 774, 338, 461, 467, 470, 485, 526, 561, 806, 523; 229/164, 235

[56] References Cited

U.S. PATENT DOCUMENTS

| | | | |
|---|---|---|---|
| 452,994 | 5/1891 | Dodd . | |
| 3,181,693 | 5/1965 | Freistat . | |
| 3,335,894 | 8/1967 | Laird . | |
| 3,467,245 | 9/1969 | Kawawada . | |
| 3,721,339 | 3/1973 | Seyer | 229/235 |
| 3,942,631 | 3/1976 | Sutherland et al. . | |
| 4,111,297 | 9/1978 | Paulin . | |
| 4,151,912 | 5/1979 | Harrold . | |
| 4,433,781 | 2/1984 | Hummel . | |
| 4,687,094 | 8/1987 | Allsop et al. . | |
| 4,750,612 | 6/1988 | Schuster . | |
| 5,098,757 | 3/1992 | Steel | 229/235 |
| 5,165,534 | 11/1992 | Kaufman et al. . | |
| 5,167,324 | 12/1992 | Miller | 229/235 |
| 5,344,024 | 9/1994 | Cohu | 206/526 |
| 5,366,080 | 11/1994 | Carstersen et al. | 206/523 |
| 5,441,198 | 8/1995 | McQueeny . | |
| 5,513,750 | 5/1996 | Rychel . | |
| 5,555,982 | 9/1996 | Kuhn et al. . | |
| 5,642,813 | 7/1997 | Nyseth . | |
| 5,730,296 | 3/1998 | Limmer . | |

*Primary Examiner*—Bryon P. Gehman
*Assistant Examiner*—Luan K. Bui
*Attorney, Agent, or Firm*—Thomas I. Rozsa; Tony D. Chen; Jerry Fong

[57] ABSTRACT

A shipping container and display case for storing, transporting and displaying a plurality of pre-assembled packages of small items. The shipping container includes a top carton and a bottom carton integrally formed and connected along a score line around the container, in such a manner that the container can be broken into the top and bottom cartons along the score line. An upper insert is inserted in the top carton and a lower insert is inserted in the bottom carton respectively. The upper and lower inserts each has a plurality of slots configured for respective insertion of the plurality of pre-assembled packages. The shipping container can be used for storing and transporting the plurality of pre-assembled packages, and the top carton can be removed by breaking the container along the score line and the upper insert can further be removed to convert the container into a display case with the lower insert left in the bottom carton and the plurality of pre-assembled packages exposed for retail display.

16 Claims, 3 Drawing Sheets

SHIPPING CONTAINING AND DISPLAY CASE FOR FASTENING PACKAGES

BACKGROUND OF THE INVENTION

1. Field of the Invention

The present invention generally relates to the field of product packaging design and construction. More particularly, the present invention relates to the field of shipping container and display case design and construction for metal fasteners.

2. Description of the Prior Art

Packaging and shipping containers made of cardboard or other corrugated materials are known in conventional art. In some instances such containers are designed to be convertible into display units for retail sales. The following (17) prior art references are found to be pertinent to the field of the present invention:

1. U.S. Pat. No. 452,994 issued to Dodd on May 26, 1891 for "Process of Preserving Eggs" (hereafter the "Dodd Patent");
2. U.S. Pat. No. 3,181,693 issued to Freistat on May 4, 1965 for "Carrying Case Insert Formed with Locked-in Polyurethane Foam" (hereafter the "Freistat Patent");
3. U.S. Pat. No. 3,335,894 issued to Laird on Aug. 15, 1967 for "Holder for Eggs" (hereafter the "Laird Patent");
4. U.S. Pat. No. 3,467,245 issued to Kawawada on Sep. 16, 1969 for "Shock Absorbing Package and Display Member" (hereafter the "Kawawada Patent");
5. U.S. Pat. No. 3,942,631 issued to Sutherland et al. on Mar. 9, 1976 for "Multi-Unit Packaging Method and Package" (hereafter the "Sutherland Patent");
6. U.S. Pat. No. 4,111,297 issued to Paulin on Sep. 5, 1978 for "Cartridge for Hardware Packages" (hereafter the "Paulin Patent");
7. U.S. Pat. No. 4,151,912 issued to Harrold on May 1, 1979 for "Storage Container" (hereafter the "Harrold Patent");
8. U.S. Pat. No. 4,433,781 issued to Hummel on Feb. 28, 1984 for "Compact Dual Bell Section Trombone Case" (hereafter the "Hummel Patent");
9. U.S. Pat. No. 4,687,094 issued to Allsop et al. on Aug. 18, 1987 for "Container Display Method and Apparatus" (hereafter the "Allsop Patent");
10. U.S. Pat. No. 4,750,612 issued to Schuster on Jun. 14, 1988 for "Combination Shipping and Display Carton" (hereafter the "Schuster Patent");
11. U.S. Pat. No. 5,165,534 issued to Kaufman et al. on Nov. 24, 1992 for "Packaging Cases Incorporating Elevating Mechanism for Displaying Contents" (hereafter the "Kaufman Patent");
12. U.S. Pat. No. 5,167,324 issued to Miller on Dec. 1, 1992 for "Shipping Carton and Display Unit for Tubes" (hereafter the "Miller Patent");
13. U.S. Pat. No. 5,441,198 issued to McQueeny on Aug. 15, 1995 for "Reclosable Product Packaging" (hereafter the "McQueeny Patent");
14. U.S. Pat. No. 5,513,750 issued to Rychel on May 7, 1996 for "Roller Blade Wheel Caddy" (hereafter the "Rychel Patent");
15. U.S. Pat. No. 5,555,982 issued to Kuhn et al. on Sep. 17, 1996 for "Convertible Shipping Container-Display Apparatus" (hereafter the "Kuhn Patent");

16. U.S. Pat. No. 5,642,813 issued to Nyseth on Jul. 1, 1997 for "Wafer Shipper and Package" (hereafter the "Nyseth Patent"); and
17. U.S. Pat. No. 5,730,296 issued to Limmer on Mar. 24, 1998 for "Ready to Stock Multiple Product Package" (hereafter the "Limmer Patent").

The Dodd Patent discloses a process for packing and preserving eggs. The process includes the steps of embedding the eggs in soft clay, and then drying the bricks of clay and protecting them from moisture.

The Freistat Patent discloses a method of filling a carrying case with a foam plastic filler and locking the filler in place in the case. It also discloses a carrying case insert formed with a locked-in polyurethane foam for protecting various items during transportation.

The Laird Patent discloses a portable lightweight egg holder. The holder has a plurality of interconnected sockets for retaining eggs.

The Kawawada Patent discloses a shock absorbing member made of foamed polystyrene. The member can also serve as a display support for displaying an article in a standing position subsequent to opening the shock absorbing package.

The Sutherland Patent discloses a method of packaging multi-unit packaged products, such as bottled or canned liquid products, in a container. The container can be readily converted into a display case or tray by removing portions of the container without disturbing the contents.

The Paulin Patent discloses a cartridge for use in loading onto display racks packages of hardware and like articles. The cartridge includes a disposable carton containing a plurality of such packages. One of the walls of the carton has a tear-strip which is removable for disposing the packages for individual pricing.

The Harrold Patent discloses a storage container for associated or related articles such as nuts and bolts. The container has a plurality of slots for receiving bolts of a given diameter and thread configurations but of different lengths.

The Hummel Patent discloses a compact tenor trombone case for carrying various trombone components, including a single B-flat trombone, a trombone with F attachment, and a slide section that mates with either the B-flat trombone or the trombone with F attachment.

The Allsop Patent discloses a container having a base containing portion and a movable cover portion. The base portion of the container has two upstanding sidewalls and is suspended from a pegboard or slot board by using two mounting adapters to engage the sidewalls.

The Schuster Patent discloses a combination shipping and display carton. The top panel of the carton is perforated near one end so that the top panel can be separated at the perforation. The top panel can be then folded to form a double thick display panel.

The Kaufman Patent discloses a packaging case incorporating an elevating mechanism for displaying the contents of the case. The packaging case may be constructed with various configurations for displaying different shaped contents such as elongated pencils or flat computer disks.

The Miller Patent discloses a shipping carton and display unit for tubes. The carton has a tear-strip which separates the upper and lower portions in all but one side to form a display case.

The McQueeny Patent discloses a reclosable product package which includes a plurality of walls. When fully assembled, the package has a package access wall and a package container wall which are disposed at an angle.

The Rychel Patent discloses a roller blade wheel caddy. The caddy has a plurality of stations for individually storing a plurality of disassembled roller blade wheel assemblies.

The Kuhn Patent discloses a shipping container which may be converted to a display apparatus for items shipped and contained within the shipping container. The convertible shipping container-display apparatus includes a cover configured for facilitating opening, to permit access to and viewing of the goods shipped and contained therein.

The Nyseth Patent discloses a plastic container for storing and shipping semiconductor wafers. The container includes a wafer carrier of substantially rigid and transparent material for supporting the wafers and maintaining the wafers in spaced apart relation.

The Limmer Patent discloses a ready to stock multiple product package which has upper and lower box portions. A plurality of identical product packages are arranged so that the spike receiving holes on the packages are in line for passage of a spike. The lower box portion can be slidably inserted into the upper box portion to close the open bottom of the upper box portion.

While various packaging and shipping containers have been disclosed by the cited references, none of them are suitable for the purpose of storing, shipping and displaying pre-assembled packages of small metal fasteners such as nails, screws, nuts and bolts and other like small items. These small metal fasteners are typically contained in clear or transparent plastic packages each containing a pre-determined quantity of such small metal fasteners. In conventional merchandising practice, such pre-assembled packages of small items are often shipped in corrugated paperboard boxes that have closure flaps which are glued or stapled together. When such boxes are received by a store, the box is usually opened in a destructive manner and therefore destroyed, and the pre-assembled packages of small items are withdrawn from the boxes and placed loosely on the display shelves of the store.

It is desirable to provide a new shipping container that can be easily convertible into a display case particularly designed and constructed for the purpose of shipping, containing and convertibly displaying a plurality of pre-assembled packages of small metal fasteners.

SUMMARY OF THE INVENTION

The present invention is a novel and unique design and construction of a shipping container which can be readily converted to a display case particularly designed to be used with pre-assembled packages of small metal fasteners such as nails, screws, nuts and bolts and other like small items.

It has been discovered, according to the present invention, that it is conventional merchandising practice to distribute, offer for sale and sell small metal fasteners in prepackaged form which is typically a pre-assembled clear or transparent plastic package containing a pre-determined quantity of such small metal fasteners, where the plastic packages are of a certain size and shape.

It has also been discovered, according to the present invention, that when such box of fastener packages is received by a store, the box is usually opened in a destructive manner. The packages are withdrawn from the container, and typically stacked onto store shelving or display units.

It has additionally been discovered, according to the present invention, that fastener packages are typically shipped in substantially conventional corrugated paperboard boxes having closure flaps which are glued or stapled together.

It is therefore an object of the present invention to provide a shipping container to ship a plurality of fastener packages and like articles.

It is an additional object of the present invention to provide a shipping container which is convertible into a display case upon opening without removal of the units from the shipping container.

It is a further object of the present invention to provide a shipping container for fasteners and like articles which can be opened by a vendor in a non-destructive manner and which has utility beyond merely serving as a shipping container, upon receipt at a vendor destination.

Described generally, the present invention is a shipping container and display case for storing, transporting and displaying a plurality of pre-assembled packages of small items. The present invention is a shipping container and display case having a top panel, a bottom panel, and four (4) sidewall panels extending between the top panel and bottom panel, where the sidewalls have a pre-cut score line around the shipping container and display case, so that the shipping container and display case may be broken into a top carton and a bottom carton along the score line. The top carton has a top panel and four (4) sidewall panels extending downwardly from the top panel, forming a hollow space inside for insertion of an upper insert. The bottom carton has a bottom panel and four (4) of sidewall panels extending upwardly from the bottom panel, forming a hollow space inside for insertion of a lower insert. The upper and lower inserts each has a plurality of slots configured for insertion of the plurality of pre-assembled packages. The shipping container and display case can be used for storing and shipping the plurality of pre-assembled packages, and the top carton can be removed by breaking the container along the score line and the upper insert can further be removed to convert the container into a display case with the lower insert left in the bottom carton and the plurality of pre-assembled packages exposed for retail display.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
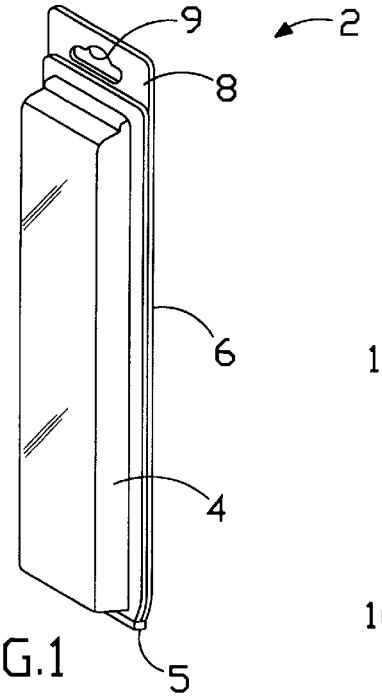
FIG. 1 is a perspective view of a pre-assembled package of small metal fasteners.

Referring to FIG. 1, there is shown at 2 a pre-assembled package of small metal fasteners such as nails, screws, nuts and bolts and other like small items. The pre-assembled package 2 typically has a front lid 4 and a back panel 6 which are press-fitted together for containing small metal fasteners and other like small items (not shown). The front lid 4 and the back panel 6 may be hingeably connected at the lower edge 5 of the pre-assembled package 2. The pre-assembled package 2 typically also has an extended upper hang tab 8 with an eyelet opening 9 for hanging the pre-assembled package 2 by a suspension rod attached to a display rack in a retail store (not shown). As an example, the pre-assembled package 2 may be made of a transparent plastic material.

Figure 2:
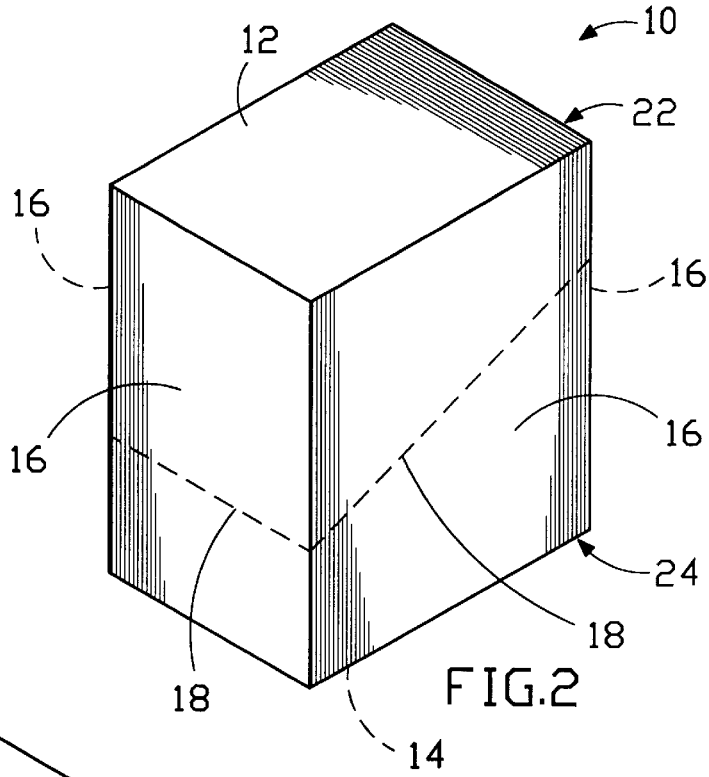
FIG. 2 is a perspective view of a preferred embodiment of the present invention shipping container and display case in its assembled configuration.

Referring to FIG. 2, there is shown a preferred embodiment of present invention shipping container and display case 10 in its fully assembled configuration. The shipping container and display case 10 has a generally rectangular shaped configuration with a top panel 12, a bottom panel 14, and four (4) sidewall panels extending between the top panel 12 and bottom panel 14. A pre-cut score line 18 is formed on the sidewall panels 16 around the shipping container and display case 10 for breaking the shipping container and display case 10 along the score line 18.

Figure 6:
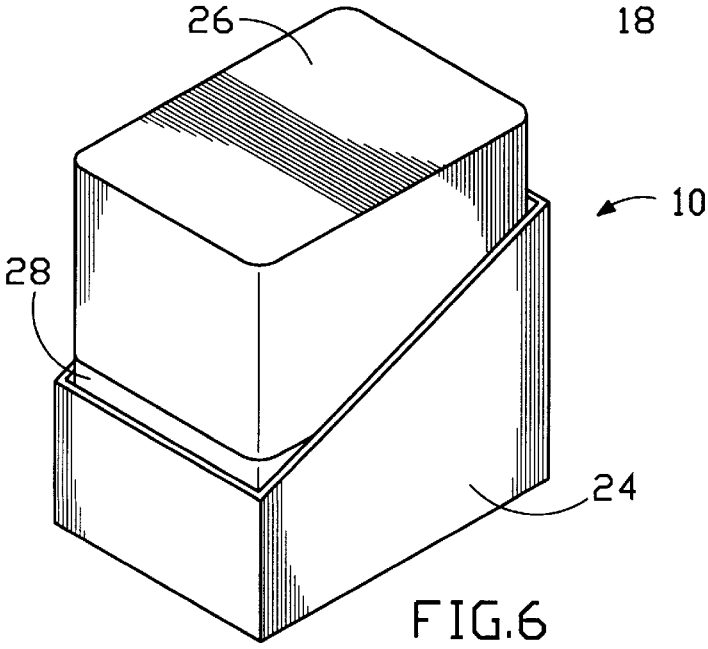
FIG. 6 is a perspective view of the preferred embodiment of the present invention shipping container and display case with its top carton removed.
Figure 3:
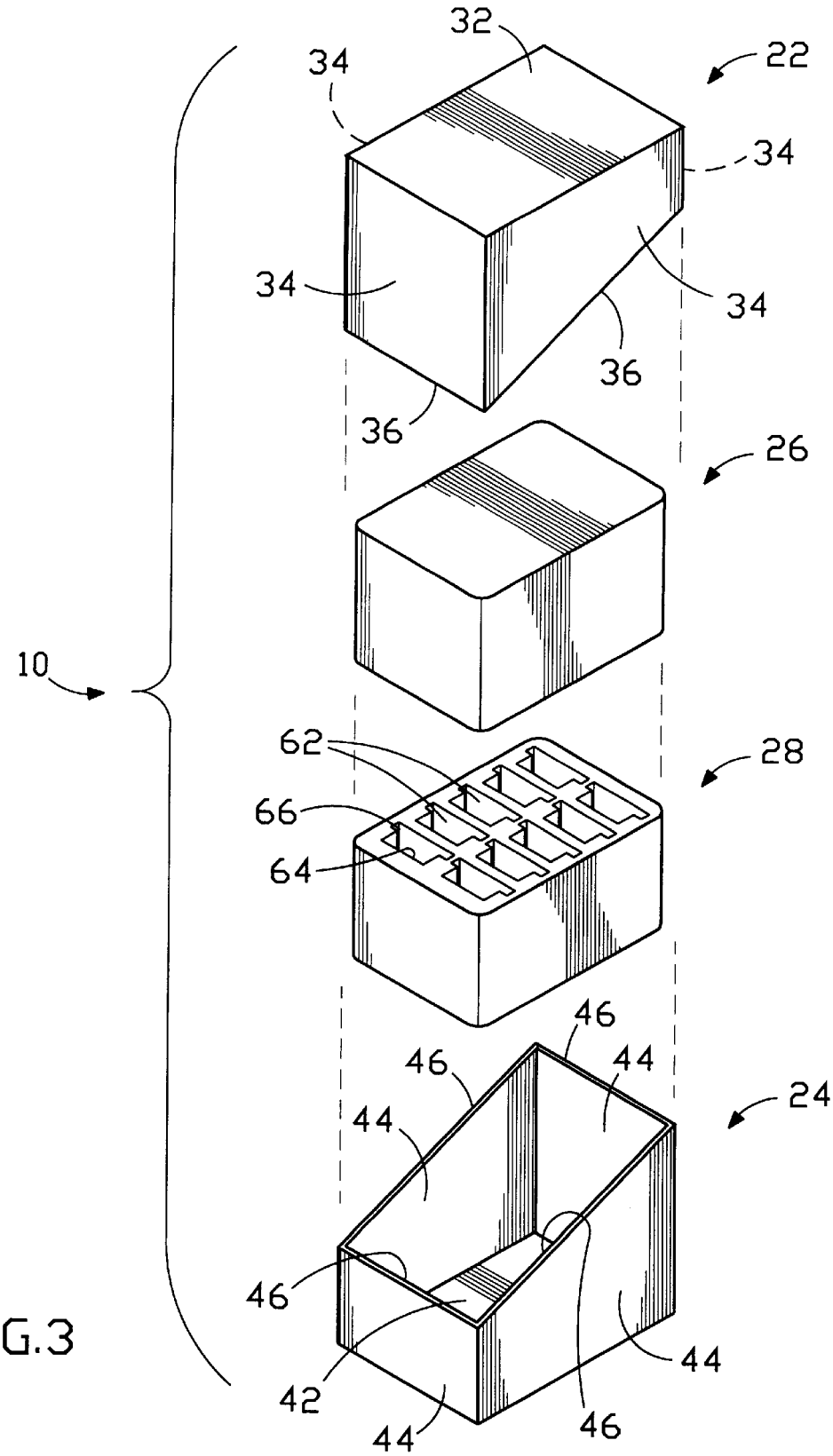
FIG. 3 is an exploded perspective view of the preferred embodiment of the present invention shipping container and display case.

Referring to FIGS. 2, 3 and 6 there is shown a preferred embodiment of present invention shipping container and display case 10 in its fully disassembled configuration. The shipping container and display case 10 includes a top carton 22, a bottom carton 24, an upper insert 26 and a lower insert 28. The top carton 22 has a top panel 32 and four (4) sidewall panels 34 extending downwardly from the top panel 32. The lower edges 36 of the sidewall panels 34 are formed along the score line 18 (shown in FIG. 1) when the shipping container and display case 10 is broken along the score line 18. The top panel 32 and the four sidewall panels 34 form a hollow space inside for insertion of the upper insert 26. As an example, the top carton may be made of cardboard or similar material.

Similarly, the bottom carton 24 has a bottom panel 42 and four (4) sidewall panels 44 extending upwardly from the bottom panel 42. The upper edges 46 of the sidewall panels 44 are formed along the score line 18 (shown in FIG. 1) when the shipping container and display case 10 is broken along the score line 18. The bottom panel 42 and the four sidewall panels 44 form a hollow space inside for insertion of the lower insert 28. As an example, the bottom carton may also be made of cardboard or similar material.

Figure 4:
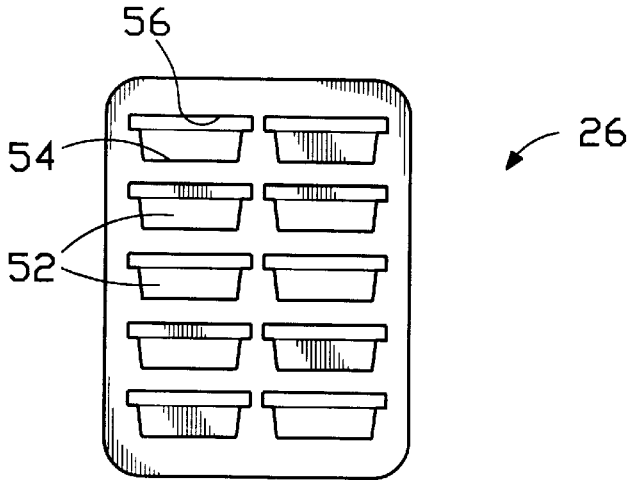
FIG. 4 is a top plan view of the slotted apertures of the upper insert of the preferred embodiment of the present invention shipping container and display case.
Figure 5:
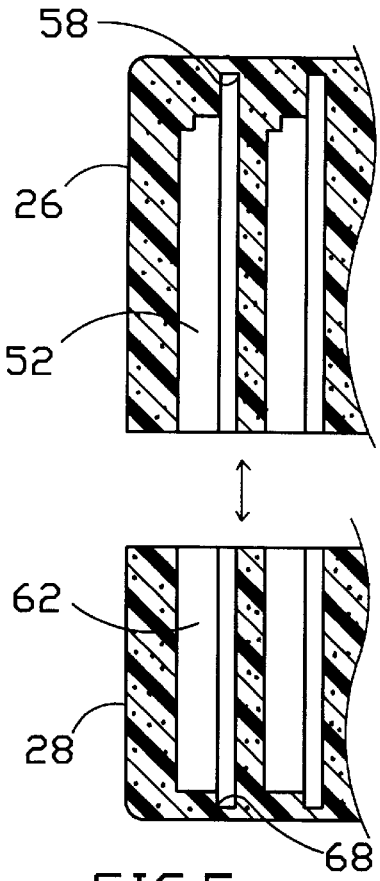
FIG. 5 is a partial cross-sectional view of the slotted apertures in the upper and lower half inserts of the preferred embodiment of the present invention shipping container and display case.

Referring to FIGS. 3, 4 and 5, the upper insert 26 has a generally rectangular shaped configuration approximately half the size of the shipping container and display case 10. The upper insert 26 has a plurality of upper slots 52 for insertion of the upper halves of a plurality of pre-assembled packages 2 respectively. Each upper slot 52 has a thick narrow portion 54 for accommodating the shape of the front lid 4 of a pre-assembled package 2, and a thin wide portion 56 for accommodating the shape of the back panel 6 of the pre-assembled package 2. The top end of each slot 52 also has an extended hollow portion 58 for accommodating the upper hang tab 9 of the pre-assembled package 2.

As an example, the upper and lower inserts 26 and 28 of the present invention shipping container and displaying case 10 may be made of a Styrofoam or other suitable material.

Similarly, the lower insert 28 also has a generally rectangular shaped configuration approximately half the size of the shipping container and display case 10. The lower insert 28 also has a plurality of lower slots 62 for insertion of the lower halves of the plurality of pre-assembled packages 2 respectively. Each lower slot 62 has a thick narrow portion 64 for accommodating the shape of the front lid 4 of a pre-assembled package 2, and a thin wide portion 66 for accommodating the shape of the back panel 6 of the pre-assembled package 2. The bottom end of each slot 62 also has a deepened hollow portion 68 for accommodating the bottom edge 5 of the pre-assembled package 2.

Figure 7:
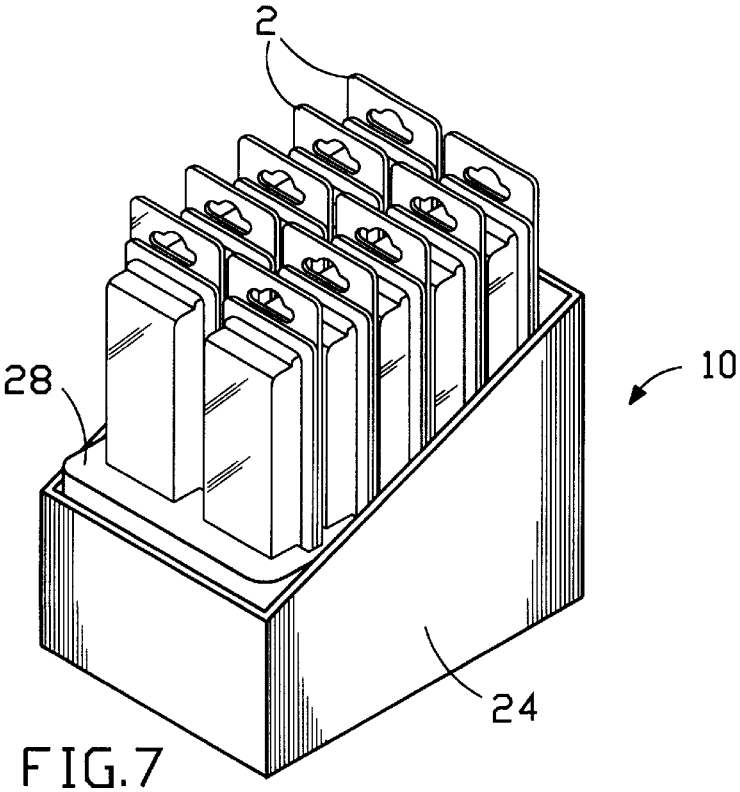
FIG. 7 is a perspective view of the preferred embodiment of the present invention shipping container and display case with its lower portion fully loaded with and for displaying of a plurality of pre-assembled packages of small metal fasteners.

Referring to FIGS. 6 and 7, as the present invention shipping container and display case 10 arrives at a retail store, the top carton can be removed by breaking the shipping container and display case 10 along the score line 18, which leaves the upper and lower inserts 26 and 28 in the bottom carton 24 and exposes the upper insert 26. The upper insert 26 can further be removed which leaves only the lower insert 28 in the bottom carton 24 and exposes the plurality of pre-assembled packages 2 for retail display.

Referring again to FIGS. 2, 3, 6 and 7, the score line 18 does not have to be always cut along a horizontal level. Rather, two opposite parallel sections of the score line 18 on two opposite parallel sidewall panels 16 respectively can be cut along an inclined direction. This will facilitate the easy removal of the upper and lower inserts 26 and 28 from the top and bottom cartons 22 and 24 respectively. It also prevents potential damage to the pre-assembled packages 2 contained inside the upper and lower inserts 26 and 28 when breaking the top and bottom cartons 22 and 24 apart along the score line 18.

Defined in detail, the present invention is a shipping container and display case for storing, transporting and displaying a plurality of pre-assembled packages of small items, comprising: (a) a generally rectangular shaped container having a top panel, a bottom panel, and a four sidewall panels extending between the top panel and bottom panel; (b) the sidewalls having a pre-cut score line around the container for breaking the container along the score line into a top carton and a bottom carton; (c) the top carton having a top panel and four sidewall panels extending downwardly from the top panel, forming a hollow space inside for insertion of an upper insert; (d) the bottom carton having a bottom panel and four sidewall panels extending upwardly from the bottom panel, forming a hollow space inside for insertion of a lower insert; (e) the upper insert having a generally rectangular shaped configuration approximately half the size of the container and having a plurality of upper slots configured for respective insertion of the upper halves of the plurality of pre-assembled packages; and (f) the lower insert having a generally rectangular shaped configuration approximately half the size of the container and having a plurality of lower slots respectively aligned with said upper slots and configured for respective insertion of the lower halves of the plurality of pre-assembled packages; (g) whereby the container can be used for storing and shipping the plurality of pre-assembled packages, and the top carton can be removed by breaking the container along the score line and the upper insert can further be removed to convert the container into a display case with the lower insert left in the bottom carton and the plurality of pre-assembled packages exposed for retail display.

Defined broadly, the present invention is a shipping container and display case for storing, transporting and displaying a plurality of pre-assembled packages of small items, comprising: (a) a container having a top panel, a bottom panel, and a multiplicity of sidewall panels extending between the top panel and bottom panel; (b) the sidewalls having a pre-cut score line around the container for breaking the container along the score line into a top carton and a bottom carton; (c) the top carton having a top panel and a multiplicity of sidewall panels extending downwardly from the top panel, forming a hollow space inside for insertion of an upper insert; (d) the bottom carton having a bottom panel and a multiplicity of sidewall panels extending upwardly from the bottom panel, forming a hollow space inside for insertion of a lower insert; and (e) the upper and lower inserts each having a plurality of respectively aligned slots configured for respective insertion of the plurality of pre-assembled packages; (f) whereby the container can be used for storing and shipping the plurality of pre-assembled packages, and the top carton can be removed by breaking the container along the score line and the upper insert can further be removed to convert the container into a display case with the lower insert left in the bottom carton and the plurality of pre-assembled packages exposed for retail display.

Defined more broadly, the present invention is a shipping container and display case for storing, transporting and displaying a plurality of pre-assembled packages of small items, comprising: (a) a container having a top carton and a bottom carton integrally formed and connected along a score line around the container, in such a manner that the container can be broken into the top and bottom cartons along the score line; (b) an upper insert inserted in the top carton and a lower insert inserted in the bottom carton; and (c) the upper and lower inserts each having a plurality of respectively aligned slots configured for respective insertion of the plurality of pre-assembled packages; (d) whereby the container can be used for storing and shipping the plurality of pre-assembled packages, and the top carton can be removed by breaking the container along the score line and the upper insert can further be removed to convert the container into a display case with the lower insert left in the bottom carton and the plurality of pre-assembled packages exposed for retail display.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A shipping container and display case for storing, transporting and displaying a plurality of pre-assembled packages of small items, comprising:

a. a generally rectangular shaped container having a top panel, a bottom panel, and a four sidewall panels extending between the top panel and bottom panel;

b. said sidewalls having a pre-cut score line around said container for breaking said container along the score line into a top carton and a bottom carton;

c. said top carton having a top panel and four sidewall panels extending downwardly from the top panel, forming a hollow space inside for insertion of an upper insert;

d. said bottom carton having a bottom panel and four sidewall panels extending upwardly from the bottom panel, forming a hollow space inside for insertion of a lower insert;

e. said upper insert having a generally rectangular shaped configuration approximately half the size of said container and having a plurality of upper slots configured for respective insertion of the upper halves of said plurality of pre-assembled packages; and f. said lower insert having a generally rectangular shaped configuration approximately half the size of said container and having a plurality of lower slots respectively aligned with said upper slots and configured for respective insertion of the lower halves of said plurality of pre-assembled packages;

g. whereby said container can be used for storing and shipping said plurality of pre-assembled packages, and said top carton can be removed by breaking said container along said score line and said upper insert can further be removed to convert said container into a display case with said lower insert left in said bottom carton and said plurality of pre-assembled packages exposed for retail display.

2. The shipping container and display case as defined in claim 1, wherein said top and bottom cartons are made of cardboard material.

3. The shipping container and display case as defined in claim 1, wherein said upper and lower inserts are made of foam material.

4. The shipping container and display case as defined in claim 1, wherein at least two parallel sections of said score line are formed along an inclined direction.

5. The shipping container and display case as defined in claim 1, wherein the preassembled package has a front lid and a back panel which are press fitted together and which are hingeably connected along a lower edge and also having an upper hang tab; and each of said upper slots of said upper insert has a thick narrow portion for accommodating the shape of the front lid of the preassembled package and a thin wide portion for accommodating the shape of the back panel and a hollow extended portion for accommodating the upper hang tab of the preassembled package.

6. The shipping container and display case as defined in claim 1, wherein the preassembled package has a front lid and a back panel which are press fitted together and which are hingeably connected along a lower edge and also having an upper hang tab, and each of said lower slots of said lower insert has a thick narrow portion for accommodating the shape of the front lid of the preassembled package, a thin wide portion for accommodating the shape of the back panel, and a deepened hollow portion for accommodating the bottom edge of the preassembled package.

7. A shipping container and display case for storing, transporting and displaying a plurality of pre-assembled packages of small items, comprising:

a. a container having a top panel, a bottom panel, and a multiplicity of sidewall panels extending between the top panel and bottom panel;

b. said sidewalls having a pre-cut score line around said container for breaking said container along the score line into a top carton and a bottom carton;

c. said top carton having a top panel and a multiplicity of sidewall panels extending downwardly from the top panel, forming a hollow space inside for insertion of an upper insert;

d. said bottom carton having a bottom panel and a multiplicity of sidewall panels extending upwardly from the bottom panel, forming a hollow space inside for insertion of a lower insert; and e. said upper and lower inserts each having a plurality of respectively aligned slots configured for respective insertion of said plurality of pre-assembled packages;

f. whereby said container can be used for storing and shipping said plurality of pre-assembled packages, and said top carton can be removed by breaking said container along said score line and said upper insert can further be removed to convert said container into a display case with said lower insert left in said bottom carton and said plurality of pre-assembled packages exposed for retail display.

8. The shipping container and display case as defined in claim 7, wherein the preassembled package has a front lid and a back panel which are press fitted together and which are hingeably connected along a lower edge and also having an upper hang tab; and each of said upper slots of said upper insert has a thick narrow portion for accommodating the shape of the front lid of the preassembled package and a thin wide portion for accommodating the shape of the back panel and a hollow extended portion for accommodating the upper hang tab of the preassembled package.

9. The shipping container and display case as defined in claim 7, wherein the preassembled package has a front lid and a back panel which are press fitted together and which are hingeably connected along a lower edge and also having an upper hang tab, and each of said lower slots of said lower insert has a thick narrow portion for accommodating the shape of the front lid of the preassembled package, a thin wide portion for accommodating the shape of the back panel, and a deepened hollow portion for accommodating the bottom edge of the preassembled package.

10. The shipping container and display case as defined in claim 7, wherein said top and bottom cartons are made of cardboard material.

11. The shipping container and display case as defined in claim 7, wherein said upper and lower inserts are made of foam material.

12. A shipping container and display case for storing, transporting and displaying a plurality of pre-assembled packages of small items, comprising:

a. a container having a top carton and a bottom carton integrally formed and connected along a score line around the container, in such a manner that the container can be broken into the top and bottom cartons along the score line;

b. an upper insert inserted in said top carton and a lower insert inserted in said bottom carton; and c. said upper and lower inserts each having a plurality of respectively aligned slots configured for respective insertion of said plurality of pre-assembled packages;

d. whereby said container can be used for storing and shipping said plurality of pre-assembled packages, and said top carton can be removed by breaking said container along said score line and said upper insert can further be removed to convert said container into a display case with said lower insert left in said bottom carton and said plurality of pre-assembled packages exposed for retail display.

13. The shipping container and display case as defined in claim 12, wherein said top and bottom cartons are made of cardboard material.

14. The shipping container and display case as defined in claim 12, wherein said upper and lower inserts are made of foam material.

15. The shipping container and display case as defined in claim 12, wherein the preassembled package has a front lid and a back panel which are press fitted together and which are hingeably connected along a lower edge and also having an upper hang tab; and each of said upper slots of said upper insert has a thick narrow portion for accommodating the shape of the front lid of the preassembled package and a thin wide portion for accommodating the shape of the back panel and a hollow extended portion for accommodating the upper hang tab of the preassembled package.

16. The shipping container and display case as defined in claim 12, wherein the preassembled package has a front lid and a back panel which are press fitted together and which are hingeably connected along a lower edge and also having an upper hang tab, and each of said lower slots of said lower insert has a thick narrow portion for accommodating the shape of the front lid of the preassembled package, a thin wide portion for accommodating the shape of the back panel, and a deepened hollow portion for accommodating the bottom edge of the preassembled package.

* * * * *